United States Patent [19]

Rutherford

[11] 4,114,387

[45] Sep. 19, 1978

[54] MINE ROOF SUPPORT

[75] Inventor: Dennis Franklin Rutherford, Bishops Cleeve, England

[73] Assignee: Dowty Mining Equipment Limited, Tewkesbury, England

[21] Appl. No.: 812,696

[22] Filed: Jul. 5, 1977

[30] Foreign Application Priority Data

Jul. 7, 1976 [GB] United Kingdom ..... 28175/76

[51] Int. Cl.[2] ..... E21D 15/44

[52] U.S. Cl. ..... 405/293

[58] Field of Search ..... 61/45 D; 299/31-33; 91/170 MP

[56] References Cited

FOREIGN PATENT DOCUMENTS

| | | | |
|---|---|---|---|
| 7,407,886 | 10/1975 | France | 61/45 D |
| 1,243,612 | 7/1967 | Fed. Rep. of Germany | 61/45 D |
| 2,026,902 | 12/1971 | Fed. Rep. of Germany | 61/45 D |
| 2,447,429 | 4/1976 | Fed. Rep. of Germany | 61/45 D |
| 1,364,221 | 8/1974 | United Kingdom | 61/45 D |

*Primary Examiner*—Dennis L. Taylor

*Attorney, Agent, or Firm*—Young & Thompson

[57] ABSTRACT

A mine roof support having a roof-engageable means which includes a roof-engageable pad connected to the remainder of the means by a lever or levers. Ram means is provided which is operative in a direction at right-angles to, or substantially at right-angles to, the fore-and-aft direction of the support to move the lever or levers to adjust the height of the pad with respect to the remainder of the roof-engageable means.

10 Claims, 5 Drawing Figures

MINE ROOF SUPPORT

This invention relates to mine roof supports.

In accordance with the present invention a mine roof support has a roof-engageable means which includes a roof-engageable pad connected to the remainder of the means by a lever or levers, and ram means, operative in a direction at right-angles to, or substantially at right angles to, the fore-and-aft direction of the support, to move the lever or levers to adjust the height of the pad with respect to the remainder of the roof-engageable means.

By "fore-and-aft direction of the support" is meant that direction which, when the support is in an operative position in a mine working, will be substantially at right-angles to the face of the mineral being cut or otherwise worked.

The ram means may also be operative in a direction parallel to, or substantially parallel to, the roof-engageable surfaces of the roof-engageable means.

The roof-engageable pad may be mounted on a cantilever beam telescopically associated with, and forming part of, the roof-engageable means.

The ram means may be hydraulically-operable and may comprise a single ram or it may comprise a combination of rams mechanically secured together. Where two levers are provided the ram means may be secured between those layers. The ram means may be movably mounted with respect to the remainder of the roof-engageable means so as to be capable of changing its position slightly when the height of said pad is being adjusted.

The ram means may be single-acting so that when hydraulically-operated it elevates said path with respect to the remainder of the roof-engageable means, or it may be double-acting so that when hydraulically-operated in one direction it elevates said pad with respect to the remainder of the roof-engageable means, and when hydraulically-operated in the other direction it positively lowers said pad, under fluid power, from an elevated position.

The said lever or levers may each comprise a bell-crank lever, and in this case the or each bell-crank lever may be arranged to provide an included angle of 90 degrees between its arms. With two bell-crank levers, the ram means may act horizontally between said two bell-crank levers to impart vertical thrust to said pad, there being a constant relation between ram thrust and vertical thrust.

Preferably the ram means includes a thrust-limiting device, e.g. a pressure-relief valve whereby the vertical load will have a constant maximum value. Such constant maximum value will be independent of the amount of telescopic extension of the cantilever beam provided that the roof support design may enable the pad to exert maximum load at the maximum beam extension.

Figure 1:
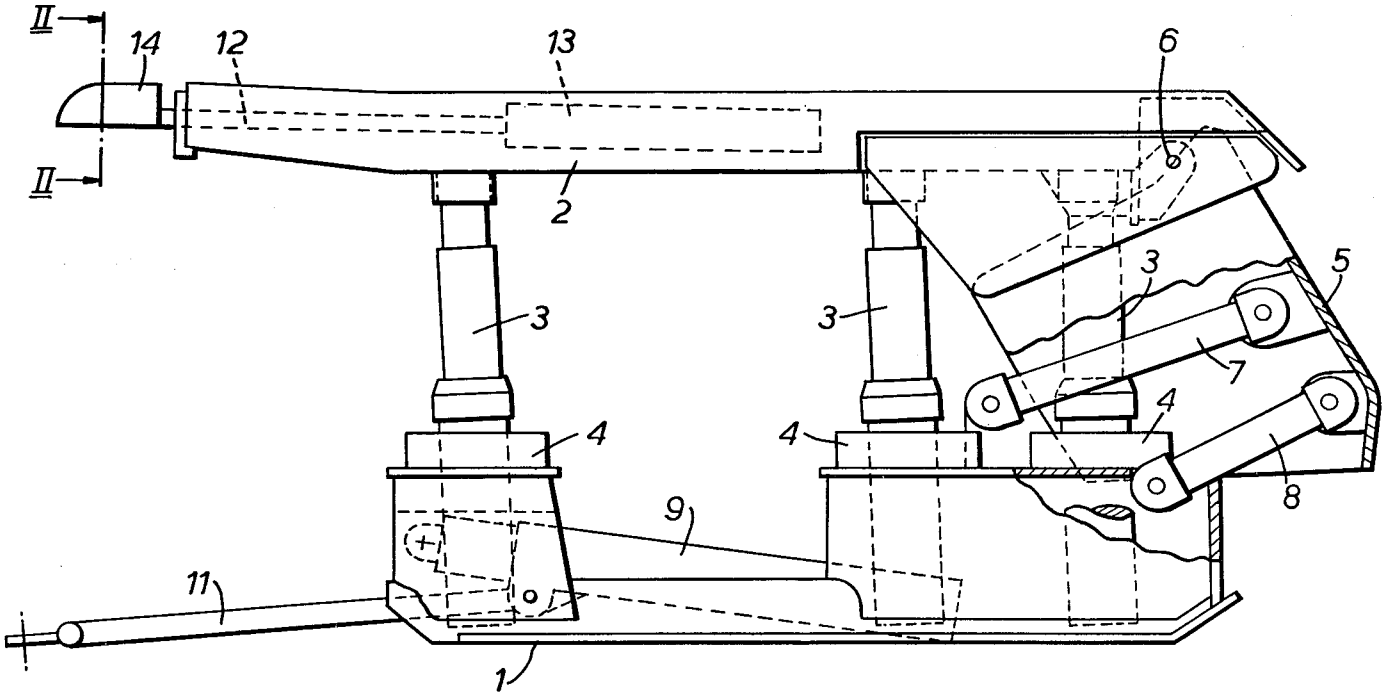
Figure 2:
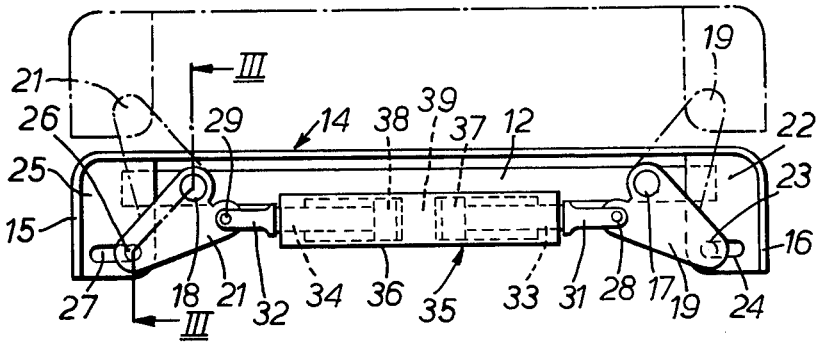
Figure 3:
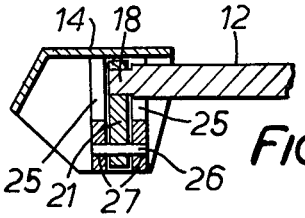
Figure 4:
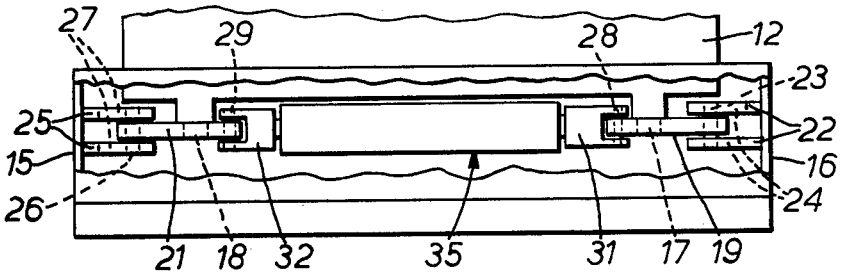
Figure 5:
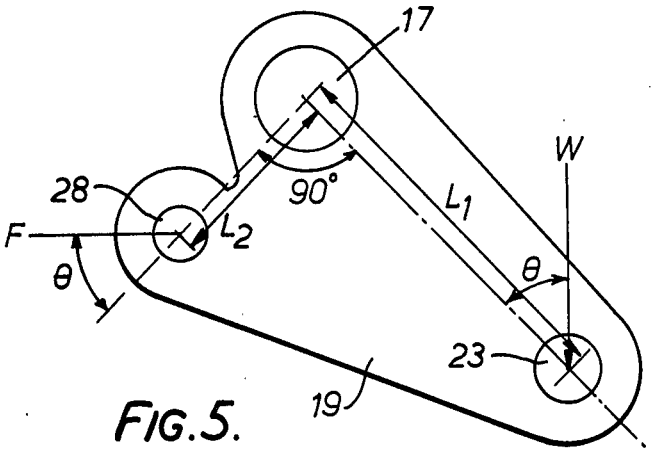

One embodiment of the invention will now be particularly described by way of example with reference to the accompanying drawings, in which:

FIG. 1 is a side elevation of a mine roof support incorporating the invention, FIG. 2 is an enlarged cross-section taken on the line II — II of FIG. 1, FIG. 3 is a cross-section taken on the line III — III of FIG. 2, FIG. 4 is an enlarged plan view, partly broken away, of the free end of the cantilever beam shown in FIG. 1, and, FIG. 5 is an enlarged view of one of the bell-crank levers shown in FIG. 2, indicating its dimensions and operational forces.

Reference is made initially to FIG. 1 of the drawings. The mine roof support comprises a floor-engaging means, such as a floor beam 1, a roof-engageable means which includes a roof beam 2, and a plurality of extendible and retractable hydraulic legs 3, acting between the floor beam 1 and the roof beam 2, for adjustably urging the roof beam into engagement with a mine roof. The legs 3 are restrained elastically against pivotal movement on the floor beam 1 by means of pre-loaded rubber mountings. At the rear end of the roof support a shield 5 is secured at a pivot 6 to the roof beam, the lower part of the shield being secured by a pair of links 7 and 8 to the floor beam 1. The links 7 and 8 may be yieldable in a lengthwise direction. Within a slot in the floor beam 1 an advancing jack 9 is located from which a relay bar 11 extends forwardly for connection to an abutment, so that by alteration in length of the advancing jack 9 the roof support may be caused to advance over the mine floor.

A cantilever beam 12, forming part of the roof-engageable means, is located within the roof beam 2. The cantilever beam is extendible and retractable with respect to the roof beam by means of a ram 13 located within the roof beam. The ram 13 is a double-acting ram within which is also provided a telescopic hydraulic connection to enable hydraulic pressure liquid to be fed through the ram into a hydraulic passage extending along the cantilever beam to the forward tip thereof.

The roof-engageable means also includes, at the end portion of the cantilever beam 12, a roof-engageable pad 14 vertically movable relative to the cantilever beam.

The mechanism for controlling the pad 14 will now be described with reference to FIGS. 2, 3, 4 and 5. The pad 14 is a hollow cover fitting over the forward end portion of the cantilever beam and including side portions 15 and 16 extending downwardly over the sides of the cantilever beam. The forward end portion of the cantilever beam 12 includes a pair of spaced pivot pins 17 and 18 projecting from its forward edge. Each of these pivot pins carries a bell-crank lever, respectively 19 and 21, such that the bell-crank levers are both pivotally movable in a vertical plane which extends transversely of the length of the cantilever beam 12. The lever 19 extends between a pair of flanges 22 secured by welding to the side portion 16 of the pad, being located therein by means of a pin 23 in the bell-crank lever which engages in horizontal slots 24 in the flanges 22. Similarly, the bell-crank lever 21 extends between a pair of flanges 25 secured by welding to the side portion 15 of the pad, the bell-crank lever 21 carrying a pin 26 which engages in horizontal slots 27 in the flanges 25. Thus, the pad is carried by the cantilever beam 12 by way of the bell-crank levers.

Each of the bell-crank levers 19 and 21 includes a further pivot pin, respectively 28 and 29, which engages within the bifurcated ends respectively 31 and 32 of piston rods 33 and 34 which extend from a ram means, in this embodiment a ram assembly 35. The ram assembly comprises a cylinder 36 located adjacent to the free end of the cantilever beam within which cylinder there are a pair of pistons 37 and 38 connected respectively to the piston rods 33 and 34, a hydraulic working space being defined between the two pistons. A wall 39 is provided centrally of the cylinder 36 which facilitates the provision of a hydraulic connection to the cylinder which joins to the working space on both sides of the wall 39. Thus the assembly 35 is supported in place by means of the pins 28 and 29, and external hydraulic connection is made centrally thereof by means of a flexible connection extending from the passage through the cantilever beam 12. Also the ram means is operative in a direction parallel to, or substantially parallel to, the roof-engageable surface of the roof beam 2 and at right-angles to, or substantially so, to the fore-and-aft direction of the roof support. The bell-crank levers 19 and 21 are identical.

Referring to FIG. 5, each bell-crank lever is generally triangular in form and essentially comprises two lever arms, one, extending between the pivot pins 17 and 23 of the lever 19 shown, having an effective length L1, and the second, extending between the pivot pins 17 and 28, having an effective length L2. The effective angle between the two lever arms is 90 degrees. Having regard to the fact that the ram assembly 35 is horizontally arranged transversely to the beam 12, the piston rod 33 will normally exert a horizontal force F on the pin 28. Also, having regard to the fact that the slot 24 which co-operates with pin 23 is normally horizontal, the vertical load W from the pad will act vertically on the pin 23. It will be seen that irrespective of the angular position of the bell-crank lever 19 about the pin 17 the angle $\theta$ between the horizontal force F and that lever arm of length L2 has the same value as the angle between the vertical force W and the other lever arm of length L1. Thus the moment exerted by force F on the bell-crank lever is $FL2 \sin \theta$ and the moment exerted by the force W on the bell-crank lever is $WL1 \sin \theta$. Thus it will be seen that the ratio W/F remains constant at a value L2/L1. The hydraulic supply to the ram assembly 35 will include a pressure-relief valve determining a maximum pressure and thus a maximum force F. Thus, for each bell-crank lever 19 and 21 the force W will have a maximum value FL2/L1 which will remain constant independently of the angular setting of the bell-crank lever.

When in use in a mine, the roof support will be used in conjunction with a number of similar supports in a line along a coal face. The roof beams 2 will engage the roof and the cantilever beams 12 will be extended by varying amounts so that each pad 14 engages the roof adjacent the coal face and is able to exert a thrust on the roof which is constant quite irrespectively of the actual extension of the cantilever beam 12. In use, the roof is rarely accurately horizontal or accurately parallel to the floor, and when the pad 14 engages the roof it is necessary that it should be able to tilt in order to engage the roof as evenly as possible. For this purpose tilting must be able to take place about two effective axes, one being a horizontal axis extending lengthwise of the cantilever beam 12 and the other being a horizontal axis extending widthwise of the cantilever beam. To accommodate tilting about the lengthwise axis of cantilever beam 12 it will be appreciated that the two bell-crank levers may be tilted to slightly different angles in order to lift the sides of the pad 14 by differing amounts. When such tilting takes place the constant relation between the load on the pad and the force exerted by the ram assembly will no longer retain its strictly constant relation, but within the limits of tilt available to the pad 14, the variation in maximum possible load on the pad 14 is quite small during pad tilting. For tilting of the pad about an axis transverse to the cantilever beam length it is merely necessary to arrange that the pivot pins 17, 18, 23, 26, 28 and 29 are loose. Such looseness also means that the ram assembly is capable of changing its position slightly during adjustment of the pad 14.

In the described embodiment a specific form of bell-crank lever has been employed but it will be realised that within the scope of the present invention other forms of lever may be used and the following are some of the possible modifications:

(a) The bell-crank levers may have lever arms which are equal in length, or alternatively, L2 may be greater than L1, provided that in both cases a desired amount of lift for the pad 14 is afforded.

(b) The bell-crank levers need not have an included angle of 90° in between the two lever arms but any other angle may be used with the disadvantage that there will not be a substantially constant relation between the load on the pad and the hydraulic force exerted by the ram assembly.

(c) In the described embodiment two bell-crank levers have been used, but it is also possible within the invention to use any number of bell-crank levers. It is even possible to use one bell-crank lever on its own.

(d) The pivot axis for the or each bell-crank lever need not necessarily be parallel to the length of the cantilever beam. Whilst it is preferable that the lever axis or axes should be horizontal it or they may take up any suitable position relative to the length of the cantilever beam.

(e) Whilst one advantage of the illustrated construction is that the ram assembly is disposed horizontally, it is within the scope of the invention for the ram assembly to be inclined to the horizontal in order to exert its thrust on the lever or levers for lifting the pad.

(f) In the desired embodiment the ram assembly is single-acting in the sense that it is only possible for the ram assembly to raise the pad into contact with the roof. Any lowering of the pad is accomplished merely by releasing hydraulic pressure from the ram assembly. Nevertheless, it is within the scope of the invention to arrange that the ram assembly is double-acting in order to enable positive lowering of the pad to be obtained.

I claim:

1. A mine roof support having a roof-engageable means which includes a roof-engageable pad, at least one lever by which said pad is connected to the remainder of the roof-engageable means, and ram means which is disposed within the profile in plan of said pad and which is operably connected to the pad, said pad being so shaped in plan that its maximum dimension in the fore-and-aft direction of the support (as herein defined) is substantially less than the maximum dimension thereof at right-angles to that direction, and said ram means being operative in a direction at right-angles to, or substantially at right-angles to, said fore-and-aft direction of the support to move said lever to adjust the height of the pad with respect to the remainder of the roof-engageable means.

2. A mine roof support as claimed in claim 1, wherein said ram means is also operative in a direction parallel to the roof-engageable surfaces of the roof-engageable means.

3. A mine roof support as claimed in claim 1, wherein said roof-engageable pad is mounted on a cantilever beam telescopically associated with, and forming part of, the roof-engageable means.

4. A mine roof support as claimed in claim 1, wherein said ram means is hydraulically-operable.

5. A mine roof support as claimed in claim 4, wherein said ram means comprises a single ram.

6. A mine roof support as claimed in claim 1, wherein two of said levers are provided and said ram means is secured between those levers.

7. A mine roof support as claimed in claim 1, wherein the ram means is movably mounted with respect to the remainder of the roof-engageable means so as to be capable of changing its position slightly when the height of said pad is being adjusted.

8. A mine roof support as claimed in claim 4, wherein said ram means is single-acting so that when hydraulically-operated it elevates said pad with respect to the remainder of said roof-engageable means.

9. A mine roof support as claimed in claim 4, wherein said ram means is double-acting so that when hydraulically-operated in one direction it elevates said pad with respect to the remainder of the roof-engageable means, and when hydraulically-operated in the other direction it positively lowers said pad, under fluid power, from an elevated position.

10. A mine roof support as claimed in claim 1, wherein the ram means includes a thrust-limiting device.

* * * * *